United States Patent [19]

Yamato et al.

[11] Patent Number: 4,708,115

[45] Date of Patent: Nov. 24, 1987

[54] METHOD OF CORRECTING AIR-FUEL RATIO FOR ATMOSPHERIC PRESSURE IN INTERNAL COMBUSTION ENGINES

[75] Inventors: Akihiro Yamato; Takafumi Nishikawa, both of Wako, Japan

[73] Assignee: Honda Giken Kogyo K.K., Tokyo, Japan

[21] Appl. No.: 5,638

[22] Filed: Jan. 21, 1987

[30] Foreign Application Priority Data

Jan. 22, 1986 [JP] Japan ..... 61012353

[51] Int. Cl.[4] ..... F02D 41/34

[52] U.S. Cl. ..... 123/494; 123/412; 123/478

[58] Field of Search ..... 123/412, 478, 488, 494, 123/489, 440

[56] References Cited

U.S. PATENT DOCUMENTS 4,271,797 6/1981 McCarbery ..... 123/412

4,481,929 11/1984 Hasegawa ..... 123/489 X 4,590,563 5/1986 Matsumura et al. ..... 123/412 X

FOREIGN PATENT DOCUMENTS 32952 2/1985 Japan ..... 123/494

*Primary Examiner*—Tony M. Argenbright

*Attorney, Agent, or Firm*—Arthur L. Lessler

[57] ABSTRACT

An amount of fuel to be supplied to an internal combustion engine is determined in dependence upon operating conditions of the engine and is corrected by a correction variable dependent upon atmospheric pressure. The correction variable is set so as to increase with a decrease in atmospheric pressure, and the set value of the correction variable is modified so as to decrease with a rise in the engine rotational speed. The correction variable resulting from this modification is added to the amount of fuel to be supplied to the engine to correct the same.

5 Claims, 4 Drawing Figures

METHOD OF CORRECTING AIR-FUEL RATIO FOR ATMOSPHERIC PRESSURE IN INTERNAL COMBUSTION ENGINES

BACKGROUND OF THE INVENTION

This invention relates to a method of correcting the air-fuel ratio of an air-fuel mixture supplied to an internal combustion engine so as to take atmospheric pressure into account. More particularly, the invention relates to a method of correcting the air-fuel ratio for atmospheric pressure so as to avoid a leaner air-fuel ratio from being brought about when the engine is operating under a small load.

A known method of controlling the supply of fuel to an internal combustion engine having a fuel injection device entails setting a period of time during which the valve of the injection device is to be opened to a basic value determined in dependence upon engine rotational speed and absolute pressure in the engine intake pipe, and correcting the set basic period of time during which the valve is to be opened in dependence upon sensed values of operating parameters (e.g. engine temperature, throttle valve opening, atmospheric pressure) representing operating conditions of the engine, thereby deciding an amount of fuel supply in such a manner that the air-fuel ratio of the mixture supplied to the engine will attain a desired air-fuel ratio, e.g. a stoichiometric mixture ratio (e.g. Japanese Provisional Patent Publication (Kokai) No. 58-85337).

When an internal combustion engine is operated under a low atmospheric pressure such as exists at a high altitude, the drop in atmospheric pressure is accompanied by a decline in engine back pressure, namely the pressure in the exhaust pipe. A consequence of the reduction in back pressure is a higher engine exhaust efficiency, as a result of which the charging efficiency rises. This in turn causes a leaner mixture to be supplied to the engine, unless a countermeasure is taken to compensate for the drop in atmospheric pressure. This tendency toward a leaner mixture becomes more pronounced the lower the rotational speed of the engine and the smaller the engine load. More specifically, since the back pressure of the engine is very low when the engine is operating under a small load as during rotation at low speed, the back pressure is readily influenced by a change in atmospheric pressure. The smaller the engine load becomes in such case, the greater the rate at which back pressure declines with respect to a drop in atmospheric pressure. This results in a correspondingly higher exhaust efficiency and, hence, a correspondingly greater rate of increase in charging efficiency. The end result is a mixture which will become more lean so long as the amount of fuel supplied is constant.

The conventional fuel supply control method mentioned above attempts to deal with this problem by calculating a correction value, namely a value which corrects the basic value of valve opening period for atmospheric pressure, based upon the prevailing value of atmospheric pressure and the intake pipe absolute pressure value, which is indicative of the magnitude of engine load, thereby deciding a correction value that conforms to operating conditions of the engine. However, the conventional method relies upon a complicated arithmetic expression in order to calculate the correction value, as a result of which the calculation processing requires a considerable period of time. The unfortunate consequence is a control delay that renders the method impractical for use.

SUMMARY OF THE INVENTION

It is therefore an object of the invention to provide a method of correcting the air-fuel ratio for atmospheric pressure in an internal combustion engine, which method compensates for a tendency toward a leaner air-fuel ratio when the engine is operating under a small load by using a correction value, which corrects the air-fuel ratio for atmospheric pressure, dependent upon the magnitude of the engine load, the correction value being determined in a short period of time in accordance with a simple arithmetic expression.

To attain the above object, the present invention provides a method of correcting the air-fuel ratio of an air-fuel mixture to be supplied to an internal combustion engine for atmospheric pressure in which an amount of fuel to be supplied to the engine is determined in dependence upon operating conditions of the engine and the determined amount of fuel is corrected by a correction value that depends upon atmospheric pressure.

The method according to the invention is characterized by comprising the following steps:

setting the correction value in such a manner that the correction value increases with a decrease in atmospheric pressure;

modifying the set correction value in such a manner that the correction value decreases with a rise in rotational speed of the engine; and correcting the amount of fuel to be supplied to the engine by adding the modified correction value thereto.

In a preferred embodiment, the method according to the invention is characterized by comprising the following steps:

setting the correction value in such a manner that the correction value increases with a decrease in atmospheric pressure;

comparing rotational speed of the engine with a predetermined value;

obtaining a modified correction value from the set correction value by performing a calculation based on a first predetermined arithmetic expression when the rotational speed of the engine is higher than the predetermined value;

adopting the set correction value as a modified correction value when the rotational speed of the engine is lower than the predetermined value;

calculating a period of time during which the fuel injection device is opened, based on a second predetermined arithmetic expression using the modified correction value as an additive term; and injecting fuel for the calculated period of time from the fuel injection device.

Thus, in accordance with the invention, compensation is applied to mitigate the tendency toward a leaner air-fuel ratio when the engine is operating under a small load. In addition, since the correction value is calculated using a simple arithmetic expression, processing time is curtailed to eliminate the problem of control delay.

The above and other objects, features and advantages of the invention will be apparent from the following detailed description taken in conjunction with the accompanying drawings.

DETAILED DESCRIPTION

A preferred embodiment of the method in accordance with the invention will now be described with reference to the accompanying drawings.

Figure 1:
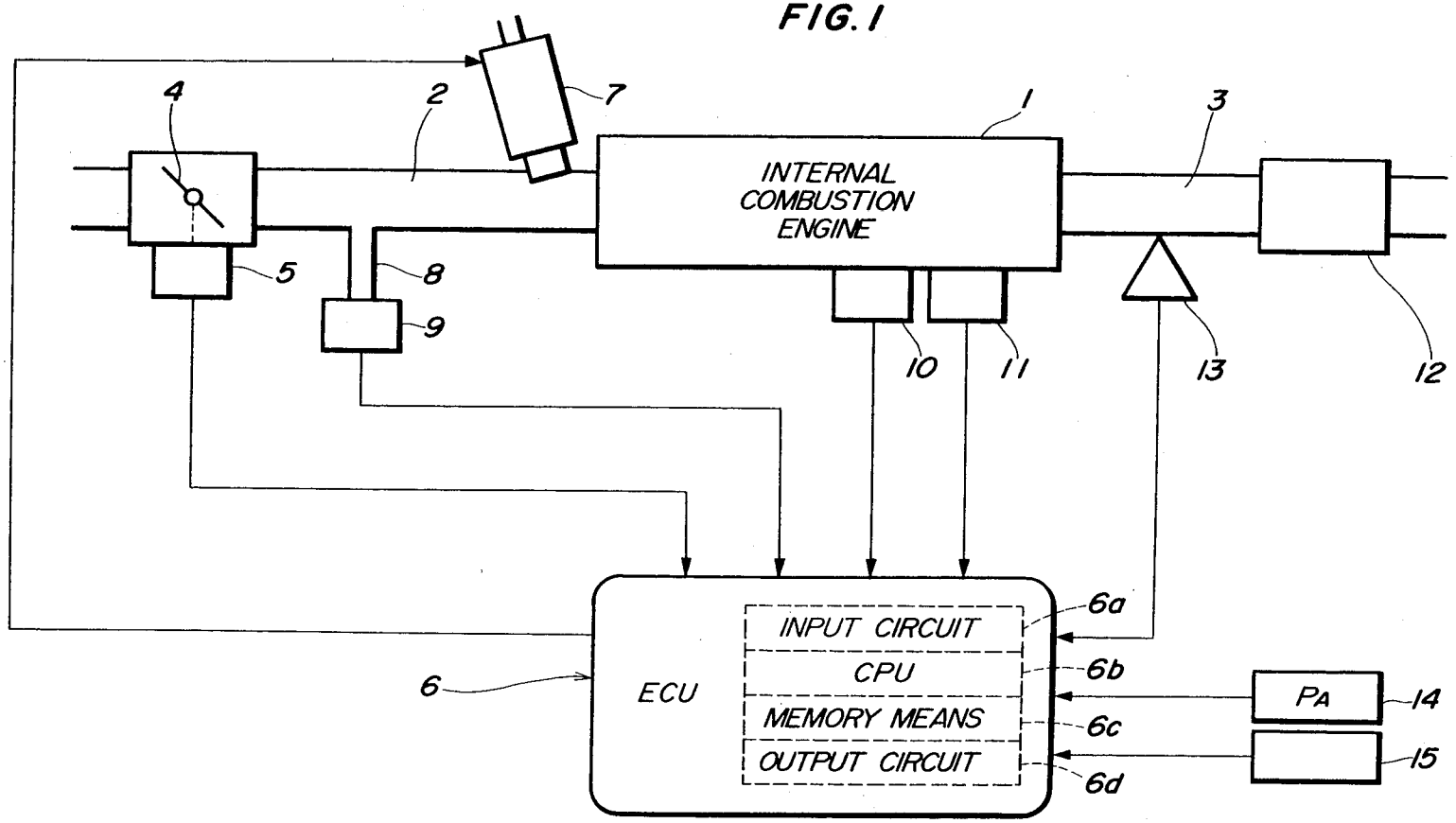
FIG. 1 is a block diagram showing the overall construction of a fuel supply control system for an internal combustion engine, to which the method of the present invention is applied.

FIG. 1 shows the overall construction of a fuel supply control system for an internal combustion engine, to which the method of the invention is applied. The internal combustion engine, designated by reference numeral 1, is e.g. of the four-cylinder type and has one end of an intake pipe 2 and one end of an exhaust pipe 3 connected thereto. The intake pipe 2 is provided at a point along its length with a throttle valve 4. A throttle valve opening ($\theta$TH) sensor 5 is connected to the throttle valve 4 for sensing the opening of the throttle valve 4 and supplying an electric signal indicative of the sensed valve opening to an electronic control unit (hereinafter referred to as "the ECU") 6.

A fuel injection valve 7 for each one of the engine cylinders is provided in the intake pipe 2 between the engine 1 and the throttle valve 4 at a location slighly upstream of the intake valve (not shown) of each cylinder. Each injection valve 7 is connected to a fuel pump, not shown, and is electrically connected to the ECU 6. The period of time during which each valve is opened to inject fuel is controlled by a signal from the ECU 6.

The intake pipe 2 is provided with an absolute pressure (PBA) sensor 9 connected thereto via a pipe 8 at a point immediately downstream of the throttle valve 4. An electric signal indicative of absolute pressure in the intake pipe 2 downstream of the throttle valve 4 is produced by the absolute pressure sensor 9 and delivered to the ECU 6.

The cylinder block of engine 1 has an engine coolant temperature sensor (TW) 10 mounted thereon. The TW sensor 10 supplies the ECU 6 with an electric signal indicative of the coolant temperature which it has sensed. An engine rotational speed (Ne) sensor 11 is arranged in facing relation to the engine camshaft or crankshaft, neither of which is shown. The Ne sensor 11 outputs a crank angle position signal (hereinafter referred to as "the TDC signal") at a predetermined crank angle position whenever the engine crankshaft rotates through 180°, namely one TDC signal pulse at a crank angle position which is a predetermined crank angle before top dead center (TDC) at the start of the suction stroke of each cylinder. The TDC signal is delivered to the ECU 6.

Arranged in the exhaust pipe 3 of the engine 1 is a three-way catalyst 12 for purifying HC, CO and NOx components in the engine exhaust gases. Also provided in the exhaust pipe 3 upstream of the three-way catalyst 12 is an oxygen concentration ($O_2$) sensor 13 for sensing the concentration of oxygen in the exhaust gases and providing the ECU 6 with a signal indicative of the oxygen concentration sensed.

An atmospheric pressure sensor 14 is connected to the ECU 6 for sensing atmospheric pressure and for providing the ECU 6 with an electric signal indicative of the sensed atmospheric pressure. Also connected to the ECU 6 are other operating parameter sensors 15 such as an engine intake air temperature sensor. These other operating parameter sensors 15 supply the ECU 6 with their output signals representing the particular physical quantities sensed.

The ECU 6 comprises an input circuit **6*a* which functions to shape input signal waveforms from some sensors, correct the voltage levels of input signals from some other sensors to predetermined levels and convert the values of these analog signals into digital signal values, a central processing unit (hereinafter referred to as "the CPU") 6*b*, memory means 6*c* for storing various arithmetic programs executed by the CPU 6*b*, a TPA-PA table, described later, and an arithmetic expression, also described later, for calculating a correction variable which corrects the air-fuel ratio for atmospheric pressure, and an output circuit 6*d* for supplying each fuel injection valve 7** with a driving signal.

The ECU 6 calculates, in synchronism with inputting of each pulse of the TDC signal, a time period TOUT during which each fuel injection valve is to be opened (hereinafter called "the valve opening period"), by using the following equation, based on the values of the various engine operating parameter signals:

$$TOUT = Ti \times K1 + K2 + TPA \quad (1)$$

where Ti represents a basic value of the valve opening period of the fuel injection valve 7. The basic valve opening period Ti is read out of the memory means **6*c* in ECU 6 on the basis of e.g. the absolute pressure PBA in the intake pipe and the engine rotational speed Ne. Further, $K_1$ and $K_2$ represent correction coefficients and correction variables, respectively, calculated in dependence upon the voltage value of a battery (not shown) for supplying power to the ECU, the fuel injection valves 7, etc. and the values of engine operating parameter signals from various sensors as aforementioned, e.g., the throttle valve opening sensor 5, the engine coolant temperature sensor 10 and the other engine operating parameter sensors 15**. TPA represents a correction variable which corrects the air-fuel ratio for atmospheric pressure in accordance with a feature of the invention. The value of this correction variable is calculated by a subroutine the details of which will be described below.

The ECU 6 supplies each fuel injection valve 7 with a driving signal for opening the valve 7 over the valve opening period TOUT obtained as set forth above.

Figure 2:
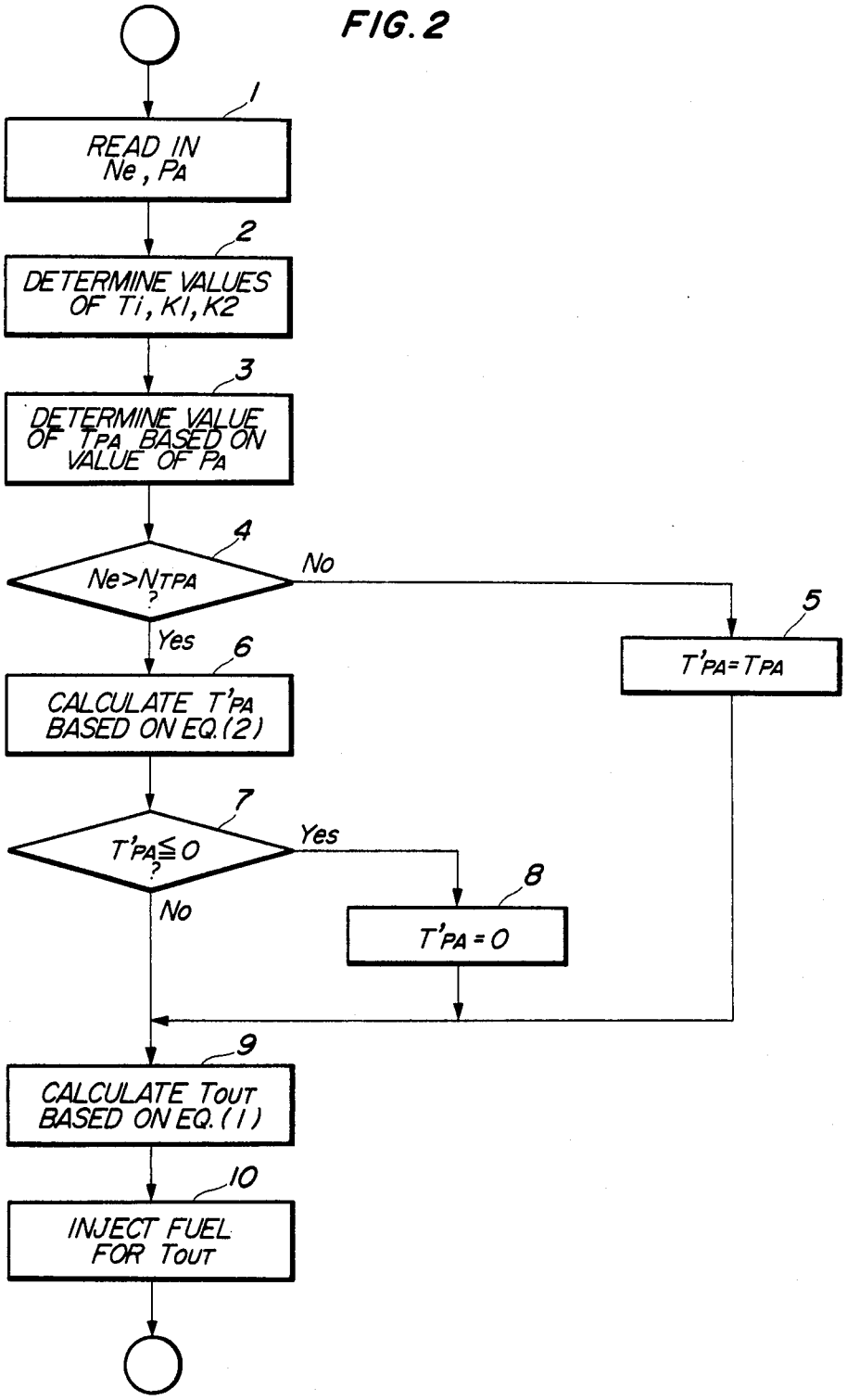
FIG. 2 is a program flowchart illustrating a subroutine for calculating a correction variable TPA which corrects the air-fuel ratio for atmospheric invention.

Reference is now made to the program flowchart of FIG. 2 to describe the subroutine through which the atmospheric pressure-dependent correction variable TPA is calculated in accordance with the invention.

The subroutine is run by the CPU **6*b* of FIG. 1 whenever a pulse of the TDC signal is generated. When the TDC signal pulse enters the ECU 6, step 1 of the program calls for the CPU 6*b* to read in the values of the engine rotational speed Ne and atmospheric pressure PA sensed by the Ne sensor 11 and atmospheric pressure sensor 14, respectively. This is followed by a step 2, at which the basic valve opening period Ti and correction coefficients and variables K1, K2 are determined based on the values of the parameter signals obtained from the various engine operating parameter sensors. The program then proceeds to a step 3, at which a value of the correction variable TPA is looked up in the TPA-PA table, which has been stored in the memory means 6c in ECU 6, on the basis of the value of atmospheric pressure PA read in at the step 1**. It should be noted that the TPA-PA table has been set in such a manner that correction variable TPA read out of the table will have such a large value that a leaner mixture will not result even if the engine load is small.

Figure 3:
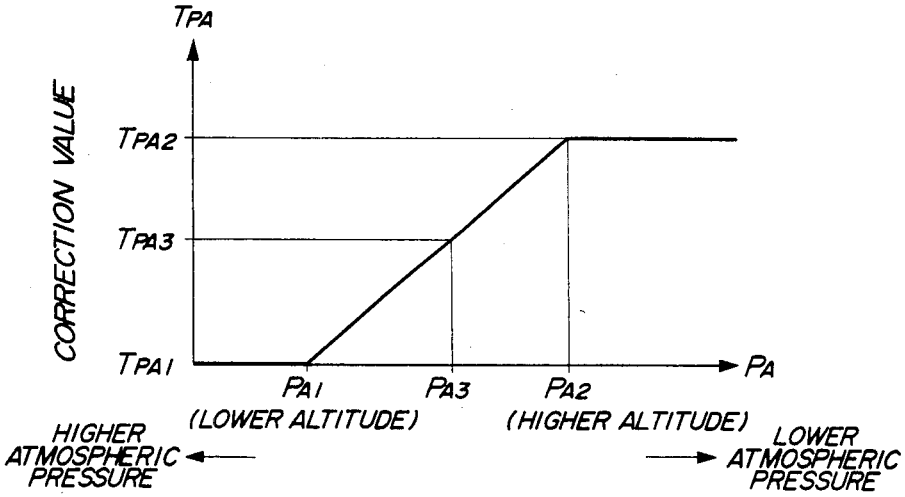
FIG. 3 is a graph useful in describing a table that indicates the relationship between the atmospheric pressure-dependent correction variable TPA and atmosheric pressure PA.

FIG. 3 is a graph useful for explaining the TPA-PA table. It will be understood from FIG. 3 that the table is set in such a manner that TPA has a constant value of TPA1 when the sensed value PA of atmospheric pressure PA is higher than a predetermined value PA1 (e.g. 600 mmHg), and a constant value of TPA2 when the sensed value of atmospheric pressure PA is lower than a predetermined value PA2 (e.g. 450 mmHg). When the sensed atmospheric pressure PA has a value PA3 lying between the predetermined values PA1, PA2, the value TPA3 of TPA is obtained by an interpolation in such a manner that the value TPA3 is set to larger values as the sensed atmospheric pressure PA decreases.

By executing step 4 et seq., the atmospheric pressure-dependent correction variable TPA obtained at the step 3 is modified in dependence upon a change in engine rotational speed Ne, namely a change in engine load.

Step 4 calls for a determination as to whether the engine rotational speed Ne is higher than a predetermined value NTPA (e.g. 1000 rpm). If the answer rendered is NO, namely that the engine is operating under a small load, then the program proceeds to a step 5, at which the value TPA obtained from the TPA-PA table is set, without change, to T'PA as a modified correction variable which corrects the air-fuel ratio for atmospheric pressure (i.e. the operation T'PA=TPA is performed at step 5). Next, at a step 9, the modified correction variable T'PA just set and the values Ti, K1, K2 determined at the step 2 are substituted into Equation (1) to calculate the valve opening period TOUT. This is followed by a step 10, at which fuel is injected from the injection valve 7 for the valve opening period TOUT thus calculated.

Figure 4:
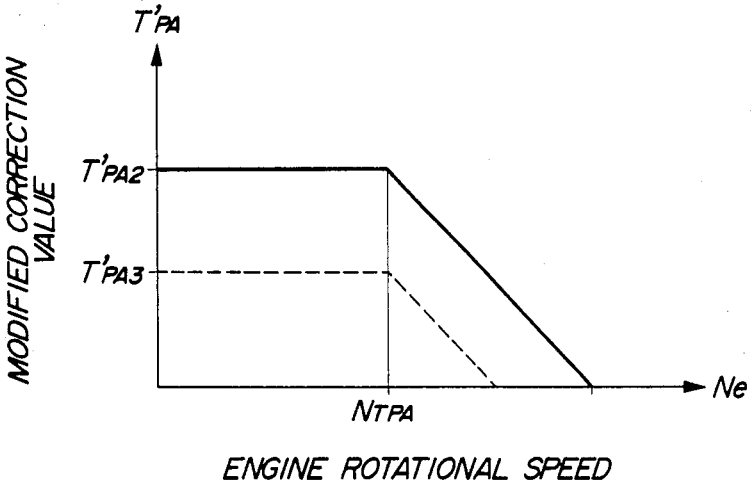
FIG. 4 is a graph showing the relationship between an atmospheric pressure-dependent correction variable T'PA resulting from a modification of the correction variable TPA and engine rotational speed Ne.

If the answer at the step 4 is YES, indicating that the engine is under a large load so that there is a reduction in the tendency toward a leaner mixture that is caused by a decrease in back pressure, the program proceeds to a step 6, at which the atmospheric pressure-dependent correction variable TPA is modified based on the following equation:

$$T'PA = TPA - kPA(Ne - NTPA) \quad (2)$$

where T'PA represents the aforementioned modified correction variable, and kPA denotes a coefficient expressing a desired rate of change in the correction variable T'PA with respect to the rotational speed Ne of the engine. This rate of change is indicated by the slope of the inclined portion of the curve shown in FIG. 4. The value of the coefficient kPA is found experimentally in dependence upon the characteristics of the particular engine.

From step 6 the program proceeds to a step 7, at which it is determined whether the modified correction variable T'PA obtained at the step 6 is equal to or less than zero. If the answer is NO, then steps 9 and 10 are executed using the correction variable T'PA calculated by Equation (2). If a YES answer is received at the step 7, then the program proceeds to a step 8, at which the modified correction variable T'PA is set to zero irrespective of the value calculated in accordance with Equation (2). This is followed by execution of the steps 9 and 10.

The results of modifying the correction variable as set forth above will now be examined. By way of example, assume that the sensed value of atmospheric presure is PA2 or PA3 in FIG. 3. In such case, the value of the correction variable TPA prior to modification will be TPA2 or TPA3, respectively. TPA2, TPA3 will then be modified to T'PA2, T'PA3, respectively, in dependence upon the rotational speed Ne prevailing at this time. The modified correction variables T'PA2, T'PA3 vary as indicated by the solid and dashed lines, respectively, shown in FIG. 4.

As set forth above, according to the invention, the amount of fuel determined in accordance with operating conditions of the engine is corrected by the correction variable TPA in dependence upon atmospheric pressure PA. The correction variable TPA is set so as to increase with a decrease in atmospheric pressure PA, and the set value of the correction variable TPA is modified so as to decrease with a rise in the engine rotational speed Ne. The correction variable T'PA resulting from this modification is added to the amount of fuel supplied to the engine to correct the same. Thus, the tendency toward a leaner air-fuel ratio when the engine is operating under a small load at a lower atmospheric pressure is mitigated. Moreover, the correction variable TPA is calculated through a simple arithmetic expression to shorten the calculation time and, hence, eliminate the control delay.

As many apparently widely different embodiments of the present invention can be made without departing from the spirit and scope thereof, it is to be understood that the invention is not limited to the specific embodiments thereof except as defined in the appended claims.

What is claimed is:

1. A method of correcting the air-fuel ratio of an air-fuel mixture to be supplied to an internal combustion engine for atmospheric pressure in which an amount of fuel to be supplied to the engine is determined in dependence upon operating conditions of the engine and the determined amount of fuel is corrected by a correction value that depends upon atmospheric pressure, the method comprising the steps of:

setting said correction value in dependence on atmospheric pressure in a manner such that the correction value increases with a decrease in atmospheric pressure;

modifying the set correction value in dependence on rotational speed of said engine in a manner such that the correction value decreases with a rise in the rotational speed of said engine; and correcting the amount of fuel to be supplied to said engine by adding the modified correction value thereto.

2. A method as claimed in claim 1, wherein said correction value is set in a manner such that it has a constant value when the atmospheric pressure is higher than a first predetermined value or lower than a second predetermined value lower than said first predetermined value, and it increases as the atmospheric pressure decreases between said first and second predetermined values.

3. A method as claimed in claim 1, wherein said set correction value is modified in a manner such that the correction value is held at the set correction value when the rotational speed of said engine is lower than a predetermined value, and the correction value decreases as the rotational speed of said engine increases from said predetermined value.

4. A method of correcting the air-fuel ratio of an air-fuel mixture to be supplied to an internal combustion engine for atmospheric pressure in which an amount of fuel to be supplied from a fuel injection device to the engine is determined in dependence upon operating conditions of the engine and the determined amount fuel is corrected by a correction value that depends upon atmospheric pressure, the method comprising the steps of:

setting said correction value in dependence on atmospheric pressure in a manner such that the correction value increases with a decrease in atmospheric pressure;

comparing rotational speed of said engine with a predetermined value;

obtaining a modified correction value from the set correction value by performing a calculation based on a first predetermined arithmetic expression when the rotational speed of said engine is higher than said predetermined value;

adopting the set correction value as a modified correction value when the rotational speed of said engine is lower than said predetermined value;

calculating a period of time during which said fuel injection device is opened, based on a second predetermined arithmetic expression using the modified correction value as an additive term; and injecting fuel for the calculated period of time from said fuel injection device.

5. A method as claimed in claim 4, wherein said first arithmetic expression is as follows:

$$T'PA = TPA - kPA(Ne - NTPA)$$

where T'PA is said modified correction value, TPA said set correction value, Ne the rotational speed of said engine, NTPA said predetermined value of the rotational speed of said engine, and kPA a coefficient a coefficient expressing a desired rate of change in said correction value T'PA with respect to the rotational speed Ne of said engine.

* * * * *